United States Patent [19]

Guenther

[11] 4,190,247

[45] Feb. 26, 1980

[54] SHEET RECEIVING APPARATUS

[75] Inventor: Joachim Guenther, Webster, N.Y.

[73] Assignee: Xerox Corporation, Stamford, Conn.

[21] Appl. No.: 455,467

[22] Filed: Mar. 28, 1974

[51] Int. Cl.[2] ..... B65H 29/60

[52] U.S. Cl. ..... 271/291; 271/292

[58] Field of Search ..... 271/173, 64, 65, 9, 271/DIG. 9, 213, 210, 139; 270/58; 211/10, 11, 51, 52, 55, 169

[56] References Cited

U.S. PATENT DOCUMENTS

| | | | |
|---|---|---|---|
| 2,241,168 | 5/1941 | Truitt | 271/173 |
| 2,429,349 | 10/1947 | Evans | 211/11 X |
| 3,122,362 | 2/1964 | Vollrath | 270/58 X |
| 3,266,798 | 8/1966 | Bleiman | 271/64 |
| 3,272,499 | 9/1966 | Baum | 271/139 X |
| 3,617,053 | 11/1971 | Menard | 271/64 |
| 3,685,819 | 8/1972 | Deutsch | 270/58 |
| 3,700,231 | 10/1972 | Aasen | 271/64 |
| 3,709,492 | 1/1973 | Baker | 271/173 |
| 3,851,872 | 12/1974 | Gerbasi | 271/173 |

*Primary Examiner*—James L. Rowland

[57] ABSTRACT

A sheet receiving apparatus for a reproducing machine includes at least one sheet receiving bin. The receiving bin includes first and second sheet supporting bin side wall members for supporting sheets therein which are pivotally mounted for their upper ends along the path of a sheet transport. When the supporting members are in a first orientation sheets in the bin are supported by the first member, and in a second and different orientation sheets in the bin are supported by the second member. The apparatus is particularly useful as an output bin or as a multibin collator. Automatically pivoting the bin or bins from one orientation to the other provides proper collation for simplexed or duplexed copies respectively.

2 Claims, 3 Drawing Figures

SHEET RECEIVING APPARATUS

BACKGROUND OF THE INVENTION

This invention relates to sheet receiving apparatuses for reproducing machines. These devices commonly take the form, for example, of output trays or sorter collators.

There are presently a number of copiers capable of copying on both sides of a sheet, a process known as duplexing. Duplexing may be carried out manually by restacking the copy sheets after copying on the first side, and then placing them in the sheet feeder supply tray for copying on the second side, or it may be carried out automatically by various means as, for example, the use of an auxiliary feeder tray such as in the Xerox "4000" copier.

One of the problems which occurs with many copying machines, as well as other kinds of reproducing machines when they do simplexing which involves imaging on only one side of a sheet or duplexing as above-noted, is the generation of improperly collated sets of copy sheets in the output tray. For simplex copying proper collation can be obtained by properly orienting the output tray so that if sheets 1 through 10 are copied serially in the order 1 through 10, they will appear in the output tray in that order. Similarly, numerous sorter collator type devices have been devised which are capable in a simplex mode of operation of providing properly collated sets of copies.

When one performs duplex copying with the above-noted output tray or sorter the resulting copies of the documents 1 through 10 are improperly collated and appear in the order 2, 1, 4, 3, etc., instead of 1, 2, 3, 4, etc., as desired.

One approach at solving this problem is set forth in IBM Technical Disclosure Bulletin, Vol. 14, No. 5, Oct. 1971, at page 1453. In accordance with the above-noted bulletin a duplexing copier is provided which incorporates a sorter collator which has feed paths which ensure that the sheets having printed matter on one side are deposited in collator bins with the printed matter facing down and sheets having printed matter on both sides are deposited with the last side copied facing up. This is accomplished using a sorter collator having two rows of back-to-back bins. One row for receiving sheets copied on one side, and the other row for receiving sheets copied on both sides. Diverters are used to direct the sheets to the appropriate transports for deposition in the selected row and bin depending on whether they were simplex or duplex copied. While this approach would appear to overcome the above-noted problem, it does so at a substantial sacrifice in space since the two rows of back-to-back bins are required as well as separate transports for each row of bins.

In U.S. Pat. No. 3,638,937, granted Feb. 1, 1972, to Schutz, there is disclosed a collator that can be adapted to accept sheets fed from either of two sides of the collator thus retaining or inverting in the receiver the uppermost side of the sheets as fed to effect a desired sheet orientation in the receiver. While the approach of this patent is more compact than that of the previously noted IBM bulletin, it is not as useful since the machine would have to be turned around in order to change the orientation of the sheets in the bin.

A variety of sorter collator devices have been proposed such as those presented in U.S. Pat. Nos. 3,561,754, granted Feb. 9, 1971, to Gaffron; 3,685,819, granted Aug. 22, 1973, to Deutsch; 3,721,435, granted Mar. 20, 1973, to Zanders, and 3,788,640, granted Jan. 29, 1974, to Stemmle wherein the sorter bins are moved or pivoted to facilitate loading thereof. In each of these devices and other devices of a similar nature, the bins are not moved to change their orientation so as to provide for proper collation of either simplexed or duplexed copy sheets.

SUMMARY OF THE INVENTION

In accordance with this invention a sheet receiving apparatus for a reproducing machine is provided which includes at least one sheet receiving means. The receiving means includes first and second members for supporting sheets therein. The device further includes means for positioning these supporting members in a first orientation wherein the sheets in the receiving means are supported by the first member or in a second and different orientation wherein the sheets in the receiving means are supported by the second member.

The sheet receiving device may comprise, for example, the output bin of a copying machine or document handling system or it may comprise a sorter collator for use with a reproducing machine. In accordance with preferred embodiments a sorter collator is provided which includes a plurality of bins which can pivot to change between orientations depending on whether simplex or duplex reproducing is being carried out.

Therefore, it is an object of this invention to provide an improved sheet receiving apparatus.

It is a further object of this invention to provide an apparatus as above including positioning means so that either simplexed or duplexed copy sheets can be received in proper collated order.

It is a still further object of this invention to provide a process for collating simplexed or duplexed copy sheets.

These and other objects will become more apparent from the following description and drawings.

DETAILED DESCRIPTION OF THE PREFERRED EMBODIMENTS

Figure 1:
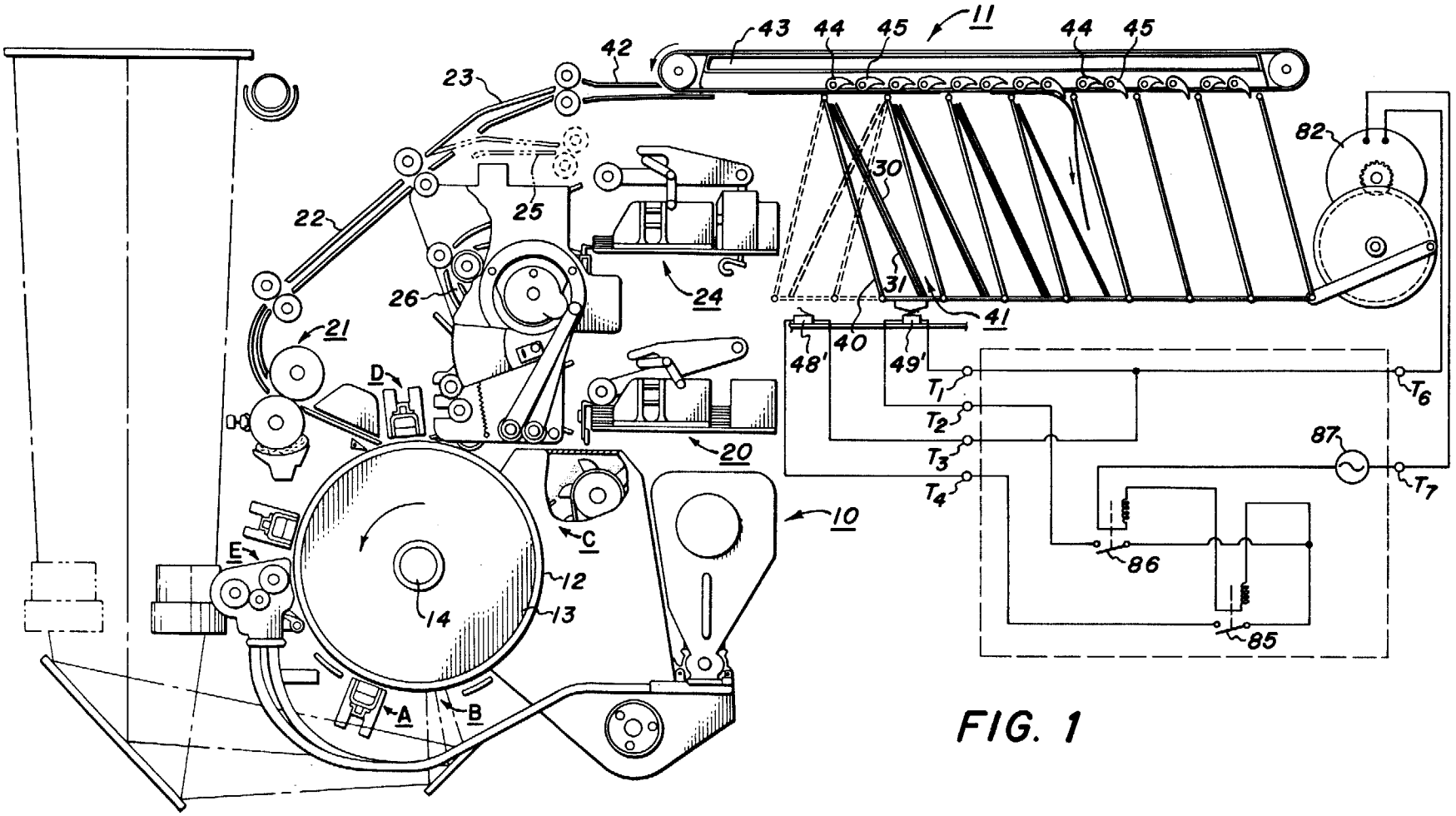
FIG. 1 is a schematic view of a xerographic reproducing machine employing a sheet receiving apparatus in accordance with this invention.

Referring to FIG. 1, there is shown a xerographic reproducing machine 10 incorporating a sheet receiving apparatus 11 in accordance with the present invention. The reproducing machine 10 will be described briefly, however, it should be apparent that the apparatus of the present invention may be used with any desired reproducing machine and is in no way limited for use with a xerographic type machine or with this specific xerographic configuration.

As shown, the automatic xerographic reproducing apparatus 10 comprises a xerographic plate 12 including a pnotoconductive layer 13 on a conductive backing and formed in the shape of the drum, which is journaled in the frame of the machine by means of shaft 14. The xerographic plate 12 is rotated in the direction indicated in FIG. 1 to cause the drum surface 13 to pass sequentially through a plurality of xerographic processing stations.

For the purpose of the present disclosure the several xerographic processing stations in the path of movement of the drum surface 13 may be described functionally as follows:

A charging station A in which a uniform electrostatic charge is desposited on the photoconductive layer 13 of the drum.

An exposure station B wherein a light or radiation pattern of an original document to be reproduced is projected onto the drum surface to dissipate the charge found thereon in the exposed areas to form a latent electrostatic image.

A development station C at which a xerographic developing material having toner particles possessing an electrostatic charge opposite to the charge found on the drum surface in the latent image areas are applied to the moving surface 13 whereby the toner particles adhere to the electrostatic latent image to make visible the image in the configuration of the original document to be reproduced.

A transfer station D in which the xerographic powder image is electrostatically transferred from the drum surface 13 to the final support material.

A drum cleaning and toner collecting station E wherein the drum surface 13 is first treated with corona and then wiped with a doctor blade to remove residual toner particles remaining thereon after image transfer.

For further details concerning the xerographic processor shown in FIG. 1, reference may be had to U.S. Pat. No. 3,752,576 granted Aug. 14, 1973, to Gerbasi.

The processor depicted in FIG. 1 was selected because it resembles functionally the Xerox "4000" copier arrangement which is adapted to automatically provide simplex operation which comprises single sided copying or duplex operation which comprises copying on both sides of the copy sheet. For simplex copying, a copy sheet is fed from the sheet feeder supply tray 20 to the transfer station D wherein the powder image is transferred from the drum to the first side of the copy sheet. The sheet is then transported to a roll type fuser 21 which fuses the image to the sheet. Thereafter, the sheet is transported along paths 22 and 23 to a suitable output device such as an output tray or a sheet receiving apparatus 11 as in accordance with the present invention as shown.

For duplex copying, transfer of an image to the first side of the sheet proceeds as previously noted, however, the sheet is transported to an auxiliary tray and sheet feeder 24 along path 25 instead of to the output device 11. To transfer an image to the second or opposing side of the copy sheet, the sheet is fed from the auxiliary tray 24 through a transport path 26 which takes it back to the transfer station with a proper orientation for receiving a powder image on its opposing side. Following transfer of the second image to the opposing side of the sheet, the second image is fused by means of the roll fuser 21 and then the sheet is transported to the output device 11 along paths 22 and 23.

A copy sheet copied on only one side (simplexed) will be oriented in the output bin shown with the first or imaged side 30 up or exposed. By this it is meant that the opposing side 31 or second side of the sheet is supported against the first side 40 of the output bin 41. The exposed side of the sheet is then the one upon which succeeding copy sheets will be deposited.

If a ten page report were being copied by the apparatus 10 of FIG. 1, in a simplex fashion, the resulting stack in the output bin 41 of the sheet receiving apparatus 11 would not be properly collated, namely, the sheets would be in the order 10, 9, 8, etc., instead of 1, 2, 3, etc. To obtain a properly collated set it would then be necessary to take the top sheet of the resulting stack and place it on the bottom, then the next topmost sheet would be placed on top of the previous sheet, and so on until sheet No. 1 is reached and a properly collated set is provided. Alternatively, as will be described in greater detail hereinafter, if the output bin 41 had an appropriate orientation as shown in dashed lines in FIG. 1, then the sheets would have been deposited in the bin in a properly collated fashion.

Now turning to the situation of a duplexed copy for a bin orientation as shown in FIG. 1, it should be evident that if the copies are copied in numerical order that the resulting stack in the output bin will be properly collated in the correct order.

It is apparent from the foregoing, therefore, that a sheet receiving apparatus of given orientation for use in conjunction with a reproducing machine is not adapted to properly collate both simplexed and duplexed copies. The reorienting of the bin 41 or bins in the sheet receiving apparatus 11 of this invention to provide an appropriate orientation for proper collation of copy sheets represents one of the principal aspects of the present invention.

Figure 2:
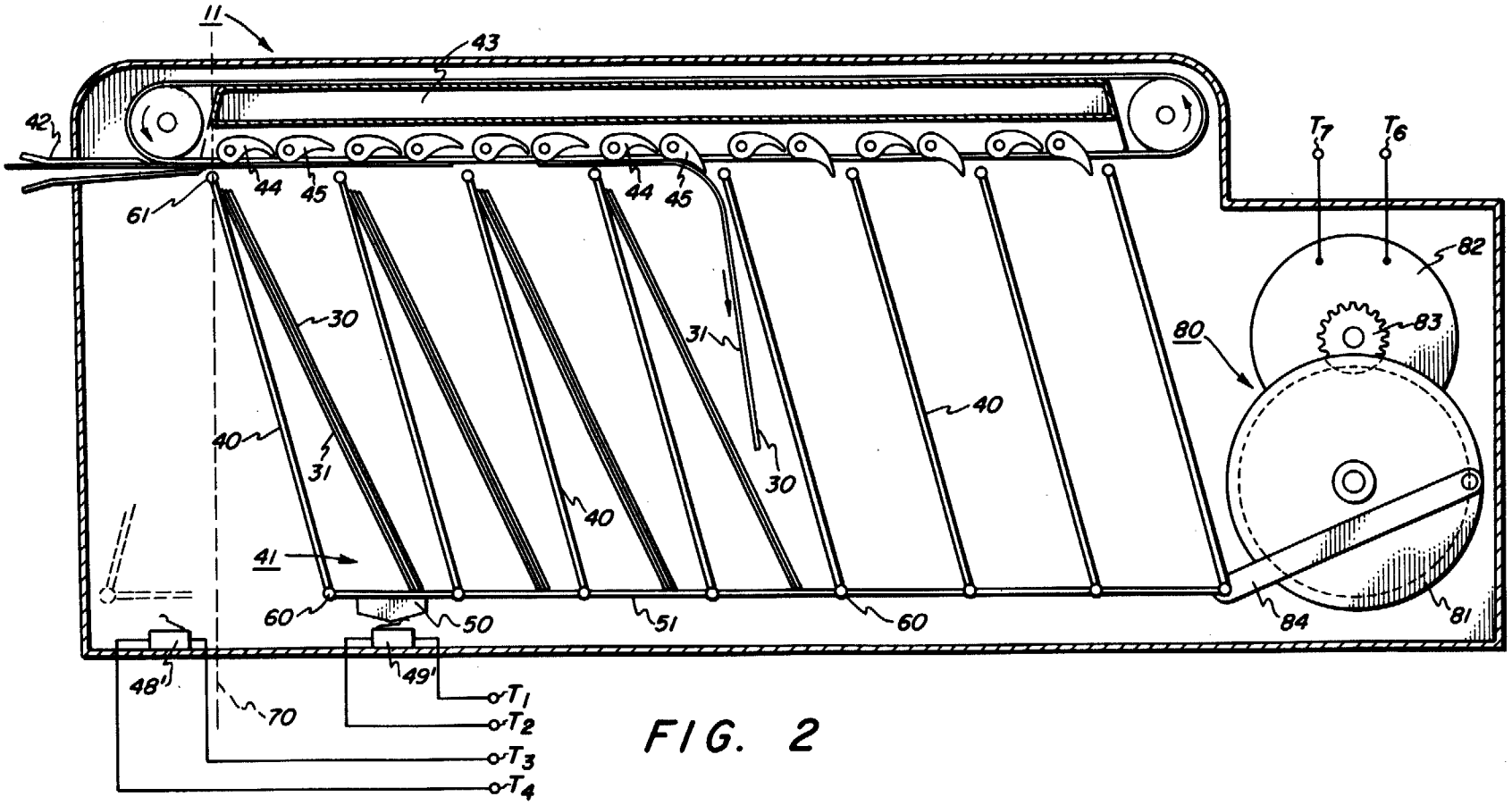
FIG. 2 is a schematic view of a sheet receiving apparatus in accordance with this invention positioned to receive properly collated sets of duplexed copy sheets.
Figure 3:
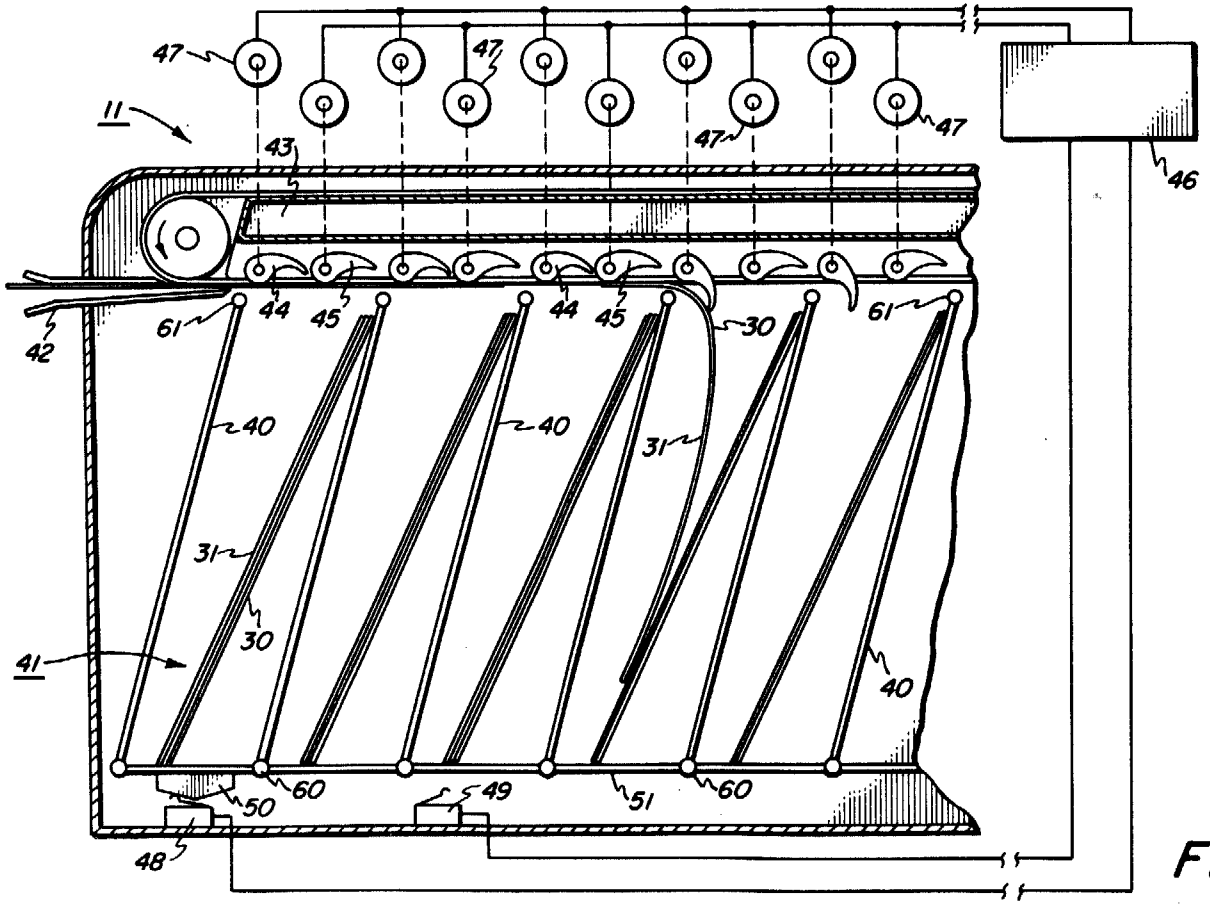
FIG. 3 is a partial schematic view of the apparatus of FIG. 2 wherein the bins have been positioned to receive properly collated sets of simplexed copy sheets.

Referring now more specifically to FIGS. 2, and 3, a sheet receiving apparatus 11 in accordance with the present invention is disclosed. The apparatus shown comprises a sorter collator, however, it should be apparent that if only a single bin 41 were employed instead of the plurality of bins as shown, the device could just as easily comprise an output bin or tray for the reproducing machine. This invention is meant to encompass both single bin devices as well as sorter collators having plural bins.

The sheet is received by the apparatus 11 through an entrance chute 42 which is coordinated with any desired transport device 23 of the reproducing machine 10 from which the sheets emanate. In the apparatus 11 shown a vacuum type belt transport 43 is employed to transport the sheets in a first plane past a plurality of sheet receiving bins 41. The use of a vacuum transport 43 in a sorter collator is known as set forth in U.S. Pat. No. 3,774,906, granted Nov. 27, 1973, to Fagen et al.

The sheets are directed into the desired bins 41 by either one of two deflector members 44 and 45 for each bin depending on the bin orientation. The specific configuration of the deflectors 44 and 45 shown is merely exemplary, and any desired type of deflector could be employed as, for example, that set forth in the previously noted U.S. Pat. No. 3,774,906. The deflectors 44 and 45 are controlled by a sorter control system 46 which may be of any desired design. The sorter control systems of U.S. Pat. Nos. 3,709,480, granted Jan. 9. 1973, to Schulze et al, and 3,709,492, granted Jan. 9, 1973, to Baker et al are exemplary of the many prior art control systems available for use in accordance with the present invention. In essence, the control system employs an electrical controller which sequentially actuates the deflector members 44 and 45 to distribute the sheets in the respective bins 41 depending on the number of copies being made.

The deflector members 44 and 45 are operated as two sets depending on bin 41 orientation. One set comprising the deflectors 44 of each bin 41 are operative when the bins are in the orientation shown in FIG. 3. The other set comprising deflectors 45 of each bin 41 are operative when the bins are oriented as shown in FIG. 2. The use of two sets of deflectors as shown allows succeeding sheets to be fed into the bins 41 without substantial interference from sheets already in the bins.

While two sets of delfector members 44 and 45 have been described herein, in order to provide the greatest freedom of access for succeeding sheets as they are fed into the bins 41 this does not form as essential part of the invention and indeed any desired means for deflecting the sheets into the bins could be employed including singular deflecting elements which are adapted to feed the sheets into the bins in either orientation.

As shown in FIG. 3, the deflecting members 44 and 45 are actuated by means of rotary solenoids 47 controlled by any desired conventional control system 46. Switches 48 and 49 are provided for rendering operative the first 44 or the second 45 set of deflector members respectively. The switches 48 and 49 are engaged by a cam member 50 carried by the bottom member 51 of the bins 41. If the first switch 48 is actuated then the first set of deflector members 44 is operative during the sorting and collating operation. If the second switch 49 is activated then the second set of deflector members 45 is operative.

In the apparatus 11 the deflector members 44 or 45 at the start of a run are all positioned to direct a sheet into the bins 41. After a first sheet is fed into the first bin in line, the deflector member associated with that bin swings out of the way so that the next sheet will be directed by the second deflector member in line into the second bin and so on until the desired number of bins have been filled. When the next set of copy sheets is to be distributed the previously noted sequence is repeated beginning with the first bin.

The bins 41, as shown in FIGS. 2 and 3, comprise substantially vertically oriented bins. The use of a vertical bin type sorter is shown, for example, in previously noted U.S. Pat. No. 3,709,492. The bins 41 are each defined by a first and a second parallel side members 40, and a bottom member 51. The side members 40 are pivotably connected at their bottom ends 60 to the bottom member 51. In the embodiment shown, the bottom member 51 is common to each of the bins 41, however, each bin could have its own separate bottom member is desired. The side members 40 are pivotably suspended at their top ends 61 to allow them to swing between a first orientation as shown in FIG. 2 and a second orientation as shown in FIG. 3. If one were to pass a plane 70 through the suspension pivot 61 of a side member 40 such that the plane is normal to the plane of initial sheet travel which is defined by the plane of the vacuum transport 43, then in the first orientation the side members 40 will be disposed on one side of the plane 70 and in the second orientation the members 40 will be disposed on the opposite side of the plane 70.

The first orientation of the bins 41 shown in FIG. 2 is the same as the orientation for the bins shown in FIG. 1 and, therefore, this orientation is well adapted for the copying system shown for receiving and properly collating duplexed copies. In the first orientation of FIG. 2, the copy sheets as they are fed into the bins 41 are supported by a first side member 40 with a first side of the copy sheet being exposed.

Referring to FIG. 3, the bins 41 are in a second orientation for receiving and properly collating simplexed copies from the copying system of FIG. 1. In the second orientation each of the copy sheets is supported by a second side member 40 which is opposed to the first side member such that the opposing side of the topmost sheet is exposed.

Referring to FIG. 2, pivoting of the bins 41 is accomplished by means of a motor drive 80. A motion imparting wheel 81 is driven by the motor 80 though gear 83. A rod 84 is pivotably connected to the bottom member 51 and is pivotably connected in an eccentric fashion to the drive wheel so as to provide the desired pivoting action for the bins 41. Rotation of the wheel 81 in the clockwise direction will cause the bins 41 to pivot to the orientation shown in FIG. 3, and a further clockwise rotation of the wheel 81 will cause the bins to pivot back to the orientation shown in FIG. 2.

Actuation of the motor 82 for controlling the bin orientation may be accomplished by any desired means. In this regard the previously noted switches 48 and 49 can include portions 48' and 49' which act as limit switches to stop the rotation of the motor at the appropriate bin orientation. Starting the motor to change bin orientation could be easily accomplished by further switches 85 and 86 or any other conventional means.

The embodiment shown in FIGS. 1 and 2 is adapted for automatic operation of the motor drive 80. By tying the switches 85 and 86 respectively to the selector switches (not shown) for simplex and duplex operation of a reproducing machine, the bins 41 will automatically position themselves in the appropriate orientation for proper collation. The switches 85 and 86 are latching type switches which remain closed upon their actuation until the AC power source 87 is disconnected from the motor by the limit switch 48' or 49'. The limit switches 48' and 49' are normally closed type switches which are opened by the interception of cam 50. The switches 85 and 86, and the power source 87 are connected to the switches 48' and 49' and to the motor 82 through terminals T1–T6.

In FIGS. 1 and 2, the bins 41 are positioned for collating duplexed copies. The machine 10 may be conditioned for simplex copying, e.g., by actuating an appropriate switch (not shown) such as the "clear special features" switch on a Xerox "4000" copier. If switch 85 is actuated simultaneously, e.g., by ganging it with that switch, then the bins 41 will be pivoted to the orientation of FIG. 3. Closing switch 85 connects the power souce 87 to the motor 82 through the normally closed switch 48'. The motor is stopped by cam 50 contacting switch 48' which disconnects the power to the motor. To return to duplex copying the machine 10 is conditioned by actuation of another switch (not shown) such as the "two sided copying" switch on a Xerox "4000" copier. If switch 86 is actuated simultaneously by ganging it with that switch, then the bins 41 will pivot back to the orientation of FIGS. 1 and 2. Closing switch 86 in this instance connects the power source 87 to the motor 82 through the normally closed switch 49' until cam 50 contacts switch 49' to open it and thereby disconnect the power.

The sheet receiving apparatus of this invention has been described by specific reference to output devices for reproducing machines. They could be employed as output devices for both the copy sheets or original documents from a suitable document handling device. However, the invention is not limited solely to output type devices and, for example, the sheets could, if desired, be fed from the bin or bins of the output device by any desired means such as that described in U.S. Pat. No. 3,580,563, granted May 25, 1971, to Bassett. If such means are provided for feeding sheets out of the bins then the bins can comprise input devices for desired apparatus as, for example, a document handler or a downline stack handling device such as sheet stacker and stapler.

The supporting members 40 and bottom member 51 for the bin 41 or bins in accordance with this invention may comprise wire forms as in U.S. Pat. No. 3,709,492, or they may comprise plate type elements as desired. They may be formed of any desired materials such as metals or plastics.

The process in accordance with the present invention comprises providing a reproducing machine adapted to operate in a first simplex mode of operation for imaging on one side of a sheet or in a second duplex mode of operation for imaging on both sides of a sheet, followed by positioning a sheet receiving device in a first orientation wherein sheets received by the receiving apparatus are supported with a first side exposed or in a second and different orientation wherein sheets received by the receiving apparatus are supported with their opposing sides exposed. The apparatus is positioned in the first orientation when the machine is in the simplex mode and thus positioned in the second orientation when the machine is in the duplex mode. In the preferred mode of operation the positioning step is carried out by pivoting the bin or bins of the sheet receiving apparatus. In the most preferred case the process is carried out automatically, namely, utilizing an automatic duplexing type reproducing machine such as the Xerox "4000" copier. For automatic operation conditioning the reproducing machine for simplex or duplex copying would automatically position the bin or bins of the sheet receiving apparatus in the appropriate orientation for simplex or duplex collation. This could be accomplished by tying actuation of the motor 82 to the actuation of the simplex or duplex mode selector switches as previously described.

The patents and copying machines specifically referred to above are intended to be incorporated by reference into the present application.

It is apparent that there has been provided in accordance with this invention, a sheet receiving apparatus and process which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A multiple bin sheet receiving apparatus, for a reproducing machine conditionable to image on either one or both sides of a sheet, comprising:

a plurality of generally parallel bin side wall members each mounted to said apparatus independently pivotally suspended generally vertically from their upper ends at fixed, spaced apart, positions to forms upper openings into said bins, and bin bottom members pivotally interconnecting the lower ends of all of said bin side wall members to define an integrally pivotable multiple sheet receiving bin apparatus with each bin side wall member being common to two adjacent bins, means for transporting said sheets generally in a plane past said upper openings of said bins, including deflector means for deflecting sheets into said openings of said bins between said spaced fixed mounting positions of said bin side wall members, wherein said deflector means comprises two alternatively operated deflector members at each said bin opening, each adjacent to an opposite said bin side wall member, and means for automatically pivoting all of said bin side wall members in parallel as an integrally connected unit about said fixed upper end pivotal mountings thereof between first and second bin orientations, wherein in said first orientation said sheets lie against one said bin side wall member of each said bin with one sheet face exposed, and wherein in said second orientation said sheets lie against the opposite adjacent said bin side wall member of said bins with the opposite sheet face exposed, to provide proper collation for simplexed or duplexed copies, respectively.

2. An apparatus as in claim 1 wherein said means for pivoting said bin side wall members comprises a unidirectional motor driven motion imparting wheel and a connecting member pivotally connected between the lower end of said bin side wall members and said wheel, said connecting member being mounted eccentrically to said wheel such that when said wheel is rotated in one direction said bins are pivoted to said first bin orientation and when said wheel is further rotated in the same direction, said bins are pivoted to said second bin orientation.

* * * * *